US006074576A

United States Patent [19]

Zhao et al.

[11] Patent Number: 6,074,576

[45] Date of Patent: Jun. 13, 2000

[54] CONDUCTIVE POLYMER MATERIALS FOR HIGH VOLTAGE PTC DEVICES

[75] Inventors: Liren Zhao, Mansfield; Prasad S. Khadkikar, Seville, both of Ohio

[73] Assignee: Therm-O-Disc, Incorporated, Mansfield, Ohio

[21] Appl. No.: 09/193,471

[22] Filed: Nov. 16, 1998

Related U.S. Application Data

[63] Continuation-in-part of application No. 08/729,822, Oct. 8, 1996, Pat. No. 5,837,164, and a continuation-in-part of application No. 09/046,853, Mar. 24, 1998, Pat. No. 5,985, 182, which is a continuation-in-part of application No. 08/729,822, Oct. 8, 1996, Pat. No. 5,837,164.

[51] Int. Cl.[7] ..... H01B 1/22; H01B 1/24; H01C 7/02

[52] U.S. Cl. ..... 252/500; 252/511; 252/512; 252/513; 252/514; 338/22 R

[58] Field of Search ..... 252/500, 511, 252/512, 513, 514, 518.1; 524/495; 338/20, 21, 22 R, 13, 25; 525/420

[56] References Cited

U.S. PATENT DOCUMENTS 4,237,441 12/1980 van Konynenburg et al. ..... 338/22
4,238,812 12/1980 Middleman et al. ..... 361/106

(List continued on next page.)

FOREIGN PATENT DOCUMENTS 929 350 of 1955 Germany .
63-302501 of 1988 Japan .

OTHER PUBLICATIONS

Narkis, M., A. Ram and Z. Stein. Electrical Properties of Carbon Black Filled Crosslinked Polyethylene. Polymer Engineering and Science vol. 21 (16): 1049–1054, Nov. 1981.

Sherman, R.D., L.M. Middleman and S.M. Jacobs. Electron Transport Processes in Conductor–Filled Polymers. Polymer Engineering and Science vol. 23 (1): 36–46, Jan., 1983.

Kulwicki, Bernard M. Trends in PTC Resistor Technology. Sample J. (Nov./Dec. 1987): 34–38.

Shrout, T.R., D. Moffatt, W. Huebner. Composites PTCR thermistors utilizing conducting borides, silicides, and carbide powders. J. Material Sci. 26 (1991): 145–154.

Ki Hyun Yoon, Yun Woo Nam. Positive temperature coefficient of resistance effects in $BaPbO_3$/polyethylene composites. J. Material Sci. 27 (1992): 4051–4055. No Month.

Wentao Jia and Xinfang Chen. PTC Effect of Polymer Blends Filled with Carbon Black. J. Appl. Polym. Sci. 54 (1994): 1219–1221. No Month.

Kozake, K., M. Kawaguchi, K. Sato, M. Kuwabara. $BaTiO_3$–based positive temperature coefficient of resistivity ceramics with low resistivities prepared by the oxalate method. J. Material Sci. 30 (1995): 3395–3400. No Month.

Huybrechts, B., Ishizaki, M. Takata. Review: The positive temperature coefficient of resistivity in barium titanate. J. Material Sci. 30 (1995): 2463–2474. No Month.

(List continued on next page.)

*Primary Examiner*—Mark Kopec
*Attorney, Agent, or Firm*—Harness, Dickey & Pierce, P.L.C.

[57] ABSTRACT

The invention provides polymeric PTC compositions and electrical PTC devices that have a high voltage capability and are capable of operating at alternating current (AC) voltages of 110 to 130 volts or greater, such as those present in household AC electrical lines. The polymeric compositions demonstrate a high PTC effect of at least $10^4$ to $10^5$ and a low initial resistivity at 25° C. of 100 Ωcm or less, preferably 10 Ωcm or less, resulting in electrical PTC devices having a resistance at 25° C. of 500 mΩ or less, preferably about 7.5 mΩ to about 200 mΩ, typically about 10 mΩ to 100 mΩ. The devices of the invention can withstand a voltage of 110 to 130 VAC or greater without failure for at least 4 hours, preferably up to 24 hours or more, after reaching the switching temperature.

38 Claims, 5 Drawing Sheets

U.S. PATENT DOCUMENTS

| | | | |
|---|---|---|---|
| 4,304,987 | 12/1981 | van Konynenburg et al. | 219/553 |
| 4,329,726 | 5/1982 | Middleman et al. | 361/58 |
| 4,420,534 | 12/1983 | Matsui et al. | 428/372 |
| 4,457,973 | 7/1984 | Matsui et al. | 428/372 |
| 4,545,926 | 10/1985 | Fouts, Jr. et al. | 252/511 |
| 4,559,112 | 12/1985 | Tamamura et al. | 204/12 |
| 4,575,620 | 3/1986 | Ishii et al. | 219/549 |
| 4,591,700 | 5/1986 | Sopory | 219/505 |
| 4,624,990 | 11/1986 | Lunk et al. | 525/199 |
| 4,636,331 | 1/1987 | Sako et al. | 252/511 |
| 4,658,121 | 4/1987 | Horsma et al. | 219/553 |
| 4,698,488 | 10/1987 | Kishimoto | 219/549 |
| 4,700,054 | 10/1987 | Triplett et al. | 219/545 |
| 4,742,212 | 5/1988 | Ishii et al. | 219/545 |
| 4,775,778 | 10/1988 | van Konynenburg et al. | 219/549 |
| 4,849,133 | 7/1989 | Yoshida et al. | 252/511 |
| 4,859,836 | 8/1989 | Lunk et al. | 219/548 |
| 4,902,562 | 2/1990 | Bahia | 428/483 |
| 4,910,389 | 3/1990 | Sherman et al. | 219/548 |
| 4,954,695 | 9/1990 | Smith-Johannsen et al. | 219/548 |
| 5,039,844 | 8/1991 | Nagahori | 219/541 |
| 5,049,850 | 9/1991 | Evans | 338/122 |
| 5,093,898 | 3/1992 | van Konynenburg et al. | 392/451 |
| 5,143,649 | 9/1992 | Blackledge et al. | 252/511 |
| 5,164,133 | 11/1992 | Ishida et al. | 264/105 |
| 5,174,924 | 12/1992 | Yamada et al. | 252/511 |
| 5,178,797 | 1/1993 | Evans | 252/508 |
| 5,227,946 | 7/1993 | Jacobs et al. | 361/106 |
| 5,231,371 | 7/1993 | Kobayashi | 338/22 |
| 5,232,631 | 8/1993 | Cao et al. | 252/500 |
| 5,246,627 | 9/1993 | Heeger et al. | 252/500 |
| 5,250,226 | 10/1993 | Oswal | 252/500 |
| 5,250,228 | 10/1993 | Baigrie et al. | 252/511 |
| 5,254,633 | 10/1993 | Han et al. | 525/327.4 |
| 5,317,061 | 5/1994 | Chu et al. | 525/200 |
| 5,318,845 | 6/1994 | Tanaka et al. | 428/373 |
| 5,340,499 | 8/1994 | Kärnä et al. | 252/500 |
| 5,378,407 | 1/1995 | Chandler et al. | 252/513 |
| 5,382,384 | 1/1995 | Baigrie et al. | 252/511 |
| 5,416,462 | 5/1995 | Demarmels et al. | 338/22 R |
| 5,422,462 | 6/1995 | Kishimoto | 219/545 |
| 5,427,855 | 6/1995 | Heeger et al. | 428/401 |
| 5,451,919 | 9/1995 | Chu et al. | 338/22 R |
| 5,491,027 | 2/1996 | Heeger et al. | 428/401 |
| 5,498,372 | 3/1996 | Hedges | 252/511 |
| 5,545,679 | 8/1996 | Bollinger, Jr. et al. | 523/512 |
| 5,554,679 | 9/1996 | Cheng | 524/495 |
| 5,580,493 | 12/1996 | Chu et al. | 252/511 |
| 5,582,770 | 12/1996 | Chu et al. | 252/511 |
| 5,705,555 | 1/1998 | Guilfoy et al. | 524/495 |
| 5,714,096 | 2/1998 | Dorfman | 252/511 |
| 5,747,147 | 5/1998 | Wartenberg et al. | 428/209 |

OTHER PUBLICATIONS

Strumpler, Ralf. Polymer composite thermistors for temperature and current sensors. *J. Appl. Phys.* 80(11), 6091–6096 (1996).

Lee, G.J. et al. Study of electrical phenomena in carbon black–filled HDPE composite. *Polymer Eng. Sci.* 38(3), 471–477 (1998).

Tang, H. et al. Electrical behavior of carbon black–filled polymer composites: Effect of Interaction Between Filler and Matrix. *J. Appl. Polym. Sci.* 51, 1159–1164 (1994).

Matsushige, K. et al. Nanoscopic analysis of the conduction mechanism in organic positive temperature coefficient composite materials. *Thin Solid Films* 273, 128–131 (1996).

Chan, Chi–Ming et al. Electrical properties of polymer composites prepared by sintering a mixture of carbon black and ultra–high molecular weight polyethylene powder. *Polymer Eng. Sci.* 37(7), 1127–1136 (1997).

Mather, P.J. & Thomas, K.M. Carbon black/high density polyethylene conducting composite materials. Part I. Structural modification of a carbon black by gasification in carbon dioxide and the effect on the electrical and mechanical properties of the composite. *J. Mater. Sci.* 32, 401–407 (1997).

Mather, P.J. & Thomas, K.M. Carbon black/high density polyethylene conducting composite materials. Part II. The relationship between the positive temperature coefficient and the volume resistivity. *J. Mater. Sci.* 32, 1711–1715 (1997).

Zweifel, Y. et al. A microscopic investigation of conducting filled polymers. *J. Mater. Sci.* 33, 1715–1721 (1998).

Fournier, J. et al. Study of the PTC effect in conducting epoxy polymer composites. *J. Chim. Phys.* 95, 1510–1513 (1998).

CONDUCTIVE POLYMER MATERIALS FOR HIGH VOLTAGE PTC DEVICES

This application is a continuation-in-part of U.S. patent application, Ser. No. 08/729,822, filed Oct. 8, 1996, issued as U.S. Pat. No. 5,837,164 on Nov. 17, 1998, and a CIP of U.S. patent application, Ser. No. 09/046,853, filed Mar. 24, 1998, now U.S. Pat. No. 5,985,182 which is a continuation-in-part of Ser. No. 08/729,822 now U.S. Pat. No. 5,837,164.

BACKGROUND OF THE INVENTION

The invention relates generally to polymeric positive temperature coefficient (PTC) compositions and electrical PTC devices. In particular, the invention relates to polymeric PTC electrical devices that have a high voltage capability and are capable of operating, for example, at alternating current (AC) voltages of 110 to 130 volts or greater, such as those present in household AC electrical lines. Such devices are useful as self-resettable sensors to protect AC motors from damage, such as that caused by over-temperature or over-current surge.

Electrical devices comprising conductive polymeric compositions that exhibit a PTC effect are well known in electronic industries and have many applications, including their use as constant temperature heaters, thermal sensors, over current regulators and low-power circuit protectors. A typical conductive polymeric PTC composition comprises a matrix of a crystalline or semi-crystalline thermoplastic resin (e.g., polyethylene) or an amorphous thermoset resin (e.g., epoxy resin) containing a dispersion of a conductive filler, such as carbon black, graphite chopped fibers, nickel particles or silver flakes. Some compositions additionally contain non-conductive fillers, such as metal oxides, flame retardants, stabilizers, antioxidants, antiozonants, crosslinking agents and dispersing agents.

At a low temperature (e.g. room temperature), the polymeric PTC composition has a contiguous structure that provides a conducting path for an electrical current, presenting low resistivity. However, when a PTC device comprising the composition is heated or an over current causes the device to self-heat to a transition temperature, a less ordered polymer structure resulting from a large thermal expansion presents a high resistivity. In electrical PTC devices, for example, this high resistivity limits the load current, leading to circuit shut off. In the context of this invention, $T_S$ is used to denote the "switching" temperature at which the "PTC effect" (a rapid increase in resistivity) takes place. The sharpness of the resistivity change as plotted on a resistance versus temperature curve is denoted as "squareness", i e., the more vertical the curve at the $T_S$, the smaller is the temperature range over which the resistivity changes from the low to the maximum values. When the device is cooled to the low temperature value, the resistivity will theoretically return to its previous value. However, in practice, the low-temperature resistivity of the polymeric PTC composition may progressively increase as the number of low-high-low temperature cycles increases, an electrical instability effect known as "ratcheting". Crosslinking of a conductive polymer by chemicals or irradiation, or the addition of inorganic fillers or organic additives are usually employed to improve electrical stability.

In the preparation of the conductive PTC polymeric compositions, the processing temperature often exceeds the melting point of the polymer by 20° C. or more, with the result that the polymers may undergo some decomposition or oxidation during the forming process. In addition, some devices exhibit thermal instability at high temperatures and/or high voltages that may result in aging of the polymer. Thus, inorganic fillers and/or antioxidants, etc. may be employed to provide thermal stability.

Polymeric PTC materials have found a variety of applications, such as self-regulating heaters and self-resettable sensors to protect equipment from damage caused by over-temperature or over-current surge. For circuit protection, the polymeric PTC devices are normally required to have the ability to self-reset, to have a low resistivity at 25° C. (10 Ωcm or less), and to have a moderately high PTC effect ($10^3$ or higher) in order to withstand a direct current (DC) voltage of 16 to 20 volts for most applications. Polyolefins, particularly polyethylene (PE)-based conductive materials, have been widely explored and employed in these low DC voltage applications. However, there are no currently available polymeric PTC sensor devices that are capable of operating at much higher voltages, such as the 110 to 130 alternating current voltages (VAC) ("Line" voltages) present in AC electrical lines, in which the effective AC current may have peaks equivalent to 156 to 184 DC volts. Polymeric PTC devices able to withstand 110 to 130 VAC would be extremely useful as self-resettable sensors to protect AC motors from damage caused by over-temperature or over-current surge. In particular, such high voltage capacity polymeric PTC devices would be useful to protect the motors of household appliances, such as dishwashers, washers, refrigerators, and the like.

A variety of conductive materials with a polymer matrix including polypropylene, polyvinyl chloride, polyvinylidene fluoride, polyamides (nylon-6, nylon-6,6, nylon-6,10 and nylon-11), polyesters and epoxy have been investigated in DC voltage applications, but most of these polymers did not exhibit both a sufficiently high PTC effect with the required low resistivity to serve as very high voltage protection devices. For example, a conductive nylon-11 composition cited in U.S. Pat. No. 4,304,987 showed a change in resistance at its switching temperature ($T_S$) of less than one order of magnitude. A conductive PTC composition comprising a polymer blend of high density PE/copolymer of ethylene and butyl acrylate (EBA), disclosed in U.S. Pat. Nos. 5,580,493 and 5,582,770, exhibits low resistivity (1 Ωcm) and DC voltage capability up to 100 volts; but this is still short of the required capability for withstanding a typical Line voltage of 110 to 130 VAC.

We have recently disclosed high temperature polymeric PTC compositions and PTC electrical devices comprising nylon-12 and/or nylon-11 based conductive materials, in U.S. patent application Ser. Nos. 08/729,822 and 09/046,853, filed Oct. 8, 1996 and Mar. 24, 1998, respectively. The disclosures of each of these patent applications are hereby incorporated by reference in their entirety. These nylon-12 and nylon-11 polymeric PTC compositions have very high switching temperatures ($T_s$) of greater than 125° C. or greater than 150° C., respectively, and a resistivity at the $T_s$ that is at least $10^3$ times, and usually greater than $10^4$ times, the resistivity at 25° C. Many of the compositions showed switching temperatures of greater than 160° C. Moreover, some of the compositions and devices fabricated from these compositions had a low resistivity of about 1 Ωcm and high voltage capability of about 100 DC volts for a single cycle without failure.

In view of the foregoing, there is a need for the development of polymeric PTC compositions, and PTC devices comprising them, that exhibit a high PTC effect, have a low initial resistivity, that exhibit substantial electrical and thermal stability, and that are capable of withstanding very high voltages, such as 110 to 130 VAC or greater, to protect AC motors used by equipment, such as household appliances and the like.

SUMMARY OF THE INVENTION

The invention provides polymeric PTC compositions and electrical PTC devices having a high voltage capability of up to 110 to 130 AC volts (VAC) or more. In particular, the polymeric compositions also demonstrate a high PTC effect (the resistivity at the $T_s$ is at least $10^4$ to $10^5$ times the resistivity at 25° C.) and a low initial resistivity at 25° C. (preferably 10 Ωcm or less, more preferably 5 Ωcm or less). The electrical PTC devices comprising these polymeric PTC compositions preferably have a resistance at 25° C. of 500 mΩ or less (preferably about 5 mΩ to about 500 mΩ, more preferably about 7.5 mΩ to about 200 mΩ, typically about 10 mΩ to about 100 mΩ) with a desirable design geometry, and can withstand a voltage of 110 to 130 VAC or greater without failure for at least 4 hours, preferably up to 24 hours or more, after reaching the $T_s$.

The polymeric PTC compositions of the invention, demonstrating the above characteristics, comprise a crystalline or semicrystalline polymer, a particulate conductive filler, and an inorganic additive and, optionally, an antioxidant to improve thermal, mechanical and electrical stability. The compositions may or may not be crosslinked to improve electrical stability before or after their use in the electrical PTC devices of the invention. Preferably, the polymer component of the composition has a melting point ($T_m$) of 100° C. to 200° C. and the PTC composition exhibits a thermal expansion coefficient of 4.0×10–4 to $2.0\times10^{-3}$ cm/cm° C. at a temperature in the range of $T_m$ to $T_m$ minus 10° C.

The conductive particulate filler may be carbon black, graphite, metal particles, or mixtures of these, as discussed further below. The inorganic additive is preferably magnesium oxide, zinc oxide, aluminum oxide, calcium carbonate, alumina trihydrate, or the like.

We have discovered that PTC compositions containing, for example, nylon-12, and/or nylon-11 as the polymer component of the composition, meet the criteria stated above, namely a high PTC effect and a low initial resistivity that are characteristic of polymer compositions demonstrating a high voltage capability. Moreover, electrical PTC devices comprising the nylon-12 and/or nylon- 11 compositions demonstrate a desirable device resistance at 25° C. of about 5 mΩ to about 500 mΩ, preferably about 7.5 mΩ to about 200 mΩ, more preferably about 10 mΩ to about 100 mΩ, and such devices are capable of withstand a voltage of 110 to 130 VAC or greater without failure for up to 24 hours after reaching its switching temperature.

The electrical PTC devices of the invention have the high voltage capability to protect equipment operating on Line current voltages from over-heating and/or over-current surges. The devices are particularly useful as self-resetting sensors for AC motors, such as those of household appliances, such as dishwashers, washers, refrigerators, and the like.

DETAILED DESCRIPTION OF THE INVENTION

Figure 1:
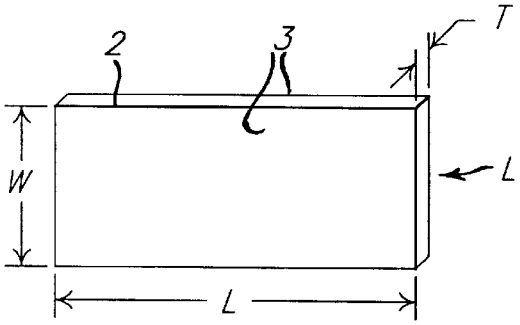
FIG. 1 is a schematic illustration of a PTC chip comprising the polymeric PTC composition of the invention sandwiched between two metal electrodes.

The high voltage-capacity polymeric PTC device of the present invention comprises a conductive polymeric composition that comprises a crystalline or semicrystalline polymer, a particulate conductive filler, an inorganic additive and, optionally, an antioxidant. The criteria for a high voltage capacity polymeric composition are (i) a high PTC effect, (ii) a low initial resistivity at 25° C., and (iii) the capability of withstanding a voltage of 110 to 130 VAC or greater while maintaining electrical and thermal stability. As used herein, the term "high PTC effect" refers to a composition resistivity at the Ts that is at least $10^4$ to $10^5$ times the composition resistivity at room temperature (for convenience, 25° C.). There is no particular requirement as to the temperature at which the composition switches to its higher resistivity state. That is, the magnitude of the PTC effect has been found to be more important than the $T_s$.

As used here, the term "low initial resistivity" refers to an initial composition resistivity at 25° C. of 100 Ωcm or less, preferably 10 Ωcm or less, more preferably 5 Ωcm or less, especially 2 Ωcm or less, thus providing for a PTC device having a low resistance at 25° C. of about 500 mΩ or less, preferably about 5 mΩ to 500 mΩ, more preferably about 7.5 mΩ to about 200 mΩ, typically about 10 mΩ to about 100 mΩ, with an appropriate geometric design and size, as discussed further below.

Preferred polymer components of the composition of the present invention (i.e., nylon-12 and/or nylon-11) are disclosed in the copending U.S. patent applications Ser. Nos. 08/729,822 and 09/046,853, incorporated by reference above. The disclosed nylon-12 and nylon-11 based conductive compositions have very high switching temperatures ($T_s$ greater than 125° C., preferably between 140° C. and 200° C., and typically between 150° C. and 195° C.). Moreover, many of these compositions demonstrate a high PTC effect of greater than $10^4$, an initial resistivity of 100 Ωcm or less at 25° C., especially 10 Ωcm or less, thus providing for a PTC device having a low resistance of about 500 mΩ or less, preferably about 5 mΩ to about 500 mΩ, more preferably about 7.5 mΩ to about 200 mΩ, typically about 10 mΩ to about 100 mΩ, with an appropriate geometric design and size.

It is known that the $T_s$ of a conductive polymeric composition is generally slightly below the melting point ($T_m$) of the polymeric matrix. If the thermal expansion coefficient of the polymer is sufficiently high near the $T_m$, a high PTC effect may occur. Further, it is known that the greater the crystallinity of the polymer, the smaller the temperature range over which the rapid rise in resistivity occurs. Thus, crystalline polymers exhibit more "squareness", or electrical stability, in a resistivity versus temperature curve.

The preferred crystalline or semicrystalline polymer component in the conductive polymeric composition of the present invention has a crystallinity in the range of 20% to 70%, and preferably 25% to 60%. In order to achieve a composition with a high PTC effect, it is preferable that the polymer has a melting point ($T_m$) in the temperature range of 100° C. to 200° C. and the PTC composition has a high thermal expansion coefficient value at a temperature in the range $T_m$ to $T_m$ minus 10° C. of about $4.0\times10^4$ to about $2.0\times10^{-3}$ cm/cm° C. Preferably, the polymer substantially withstands decomposition at a processing temperature that is at least 20° C. and preferably less than 120° C. above the $T_m$.

A nylon-12 polymer suitable for use in the invention may be obtained from Elf Atochem North America, Inc., Philadelphia, Pa., or EMS American Grilon, Inc., Sumter, S.C., or Hüls America Inc., Somerset, N.J., with the commercial names of Aesno-TL, Grilamid L20G, Vestamid L1940 and Vestamid L2140, respectively. A nylon-11 polymer suitable for use in the invention may be obtained from Elf Atochem North America, Inc., with the commercial name of Besno-TL. Each of the nylon polymers has a crystallinity of 25% or greater and a $T_m$ of 170° C. or greater. Examples of the thermal expansion coefficients (γ) of these polymers at 25° C. and within a range of $T_m$ to $T_m$ minus 10° C. is given in Table 1.

The crystalline or semicrystalline polymer component of the conductive polymeric composition of the invention may also comprise a polymer blend containing, in addition to the first polymer, 0.5% to 20% by volume of a second semicrystalline polymer, preferably a polyolefin-based or polyester-based thermoplastic elastomer. Preferably the second polymer has a melting point ($T_m$) in the temperature range of 100° C. to 200° C., and a high thermal expansion coefficient value at a temperature in the range $T_m$ to $T_m$ minus 10° C. that is at least four times greater than the thermal expansion coefficient value at 25° C.

Suitable thermoplastic elastomers for forming a polymer blend with nylon-12 and/or nylon-11 are polyolefin-based or polyester-based and obtained from Advanced Elastomer Systems, Akron, Ohio and DuPont Engineering Polymers, Wilmington, Del., with the commercial names of Santoprene and Hytrel G-4074, respectively. The thermal expansion coefficients of each of these elastomers at 25° C. and within the range $T_m$ to $T_m$ minus 10° C. are listed in Table 1.

TABLE 1

| Polymer | Aesno-TL (Nylon-12) | Grilamid L20G (Nylon-12) | Santoprene [TPE†(poly-olefin-based)] | Hytrel-G4074 [TPE†(poly-ester-based)] |
|---|---|---|---|---|
| γ* at 25° C. (cm/cm° C.) | $1.1\times10^{-4}$ | $1.2\times10^{-4}$ | $2.8\times10^{-4}$ | $1.8\times10^{-4}$ |
| γnear $T_m$** (cm/cm° C.) | $5.5\times10^{-4}$ | $4.9\times10^{-4}$ | $9.2\times10^{-4}$ | $30.9\times10^{-4}$ |

*Thermal Expansion Coefficients (γ) were measured with a Thermo Mechanical Analyzer.
**Within the range $T_m$ to $T_m$ minus 10° C.
†Thermoplastic Elastomer.

The particulate electrically conductive filler may comprise carbon black, graphite, metal particles, or a combination of these. Metal particles may include, but are not limited to, nickel particles, silver flakes, or particles of tungsten, molybdenum, gold platinum, iron, aluminum, copper, tantalum, zinc, cobalt, chromium, lead, titanium, tin alloys, or mixtures of the foregoing. Such metal fillers for use in conductive polymeric compositions are known in the art.

It is preferred to use medium to high structured carbon black with a relatively low resistivity. Examples of carbon black are Sterling N550, Vulcan XC-72, and Black Pearl 700, all available from Cabot Corporation, Norcross, Ga. A suitable carbon black, such as Sterling SO N550, has a particle size of about 0.05 to 0.08 microns, and a typical particle aggregate sphere size of 0.25 to 0.5 microns as determined by DiButyl Phthalate (DBP) absorption. The volume ratio of the particulate conductive filler to the polymer component ranges from 10:90 to 70:30, preferably 20:80 to 60:40, and more preferably 30:70 to 50:50.

In addition to the crystalline or semicrystalline polymer component and the particulate conductive filler, the conductive polymeric composition may additionally comprise additives to enhance electrical, mechanical, and thermal stability. Suitable inorganic additives for electrical and mechanical stability include metal oxides, such as magnesium oxide, zinc oxide, aluminum oxide, titanium oxide, or other materials, such as calcium carbonate, magnesium carbonate, alumina trihydrate, and magnesium hydroxide, or mixtures of any of the foregoing. Such inorganic additives may be present in the composition in an amount by weight of 1% to 15%, and more preferably from 2% to 7.5%. Organic antioxidants may be optionally added to the composition to increase the thermal stability. In most cases, these are either phenol or aromatic amine type heat stabilizers, such as N,N'-1,6-hexanediylbis(3,5-bis(1,1-dimethylethyl)-4-hydroxy-benzene) propanamide (Irganox-1098, available from Ciba-Geigy Corp., Hawthorne, N.Y.), N-stearoyl-4-aminophenol, N-lauroyl-4-aminophenol, and polymerized 1,2-dihydro-2,2,4-trimethyl quinoline. The proportion by weight of the organic antioxidant agent in the composition may range from 0.1% to 15%, preferably 0.5% to 7.5%. The conductive polymeric composition may also comprise other inert fillers, nucleating agents, antiozonants, fire retardants, stabilizers, dispersing agents, crosslinking agents, or other components.

To enhance electrical stability, the conductive polymer composition may be crosslinked by chemicals, such as organic peroxide compounds, or by irradiation, such as by a high energy electron beam, ultraviolet radiation or by gamma radiation, as known in the art. Although crosslinking is dependent on the polymeric components and the application, normal crosslinking levels are equivalent to that achieved by an irradiation dose in the range of 1 to 50 Mrads, preferably 2 to 20 Mrads, e.g., 2.5 Mrads. If crosslinking is by irradiation, the composition may be crosslinked before or after attachment of the electrodes.

In an embodiment of the invention, the high temperature PTC device of the invention comprises a PTC "chip" 1 illustrated in FIG. 1 and electrical terminals 12 and 14, as described below and schematically illustrated in FIG. 2. As shown in FIG. 1, the PTC chip 1 comprises the conductive polymeric composition 2 of the invention sandwiched between metal electrodes 3. The electrodes 3 and the PTC composition 2 are preferably arranged so that the current flows through the PTC composition over an area L×W of the chip 1 that has a thickness, T, such that W/T is at least 2, preferably at least 5, especially at least 10. The electrical resistance of the chip or PTC device also depends on the thickness and the dimensions W and L, and T may be varied in order to achieve a preferable resistance, described below. For example, a typical PTC chip generally has a thickness of 0.05 to 5 millimeters (mm), preferably 0.1 to 2.0 mm, and more preferably 0.2 to 1.0 mm. The general shape of the chip/device may be that of the illustrated embodiment or may be of any shape with dimensions that achieve the preferred resistance.

It is generally preferred to use two planar electrodes of the same area which are placed opposite to each other on either side of a flat PTC polymeric composition of constant thickness. The material for the electrodes is not specially limited, and can be selected from silver, copper, nickel, aluminum, gold, and the like. The material can also be selected from combinations of these metals, nickel-plated copper, tin-plated copper, and the like. The electrodes are preferably used in a sheet form. The thickness of the sheet is generally less than 1 mm, preferably less than 0.5 mm, and more preferably less than 0.1 mm.

Figure 2:
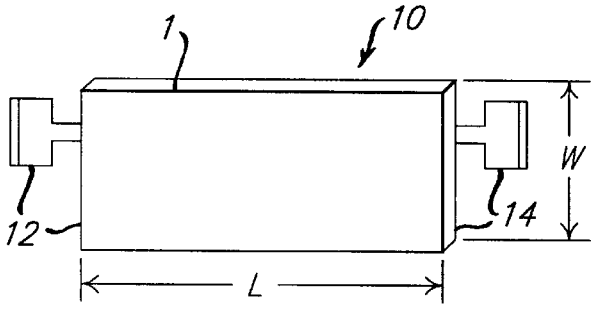
FIG. 2 is a schematic illustration of an embodiment of a PTC device according to the invention, comprising the PTC chip of FIG. 1 with two attached terminals.
Figure 3:
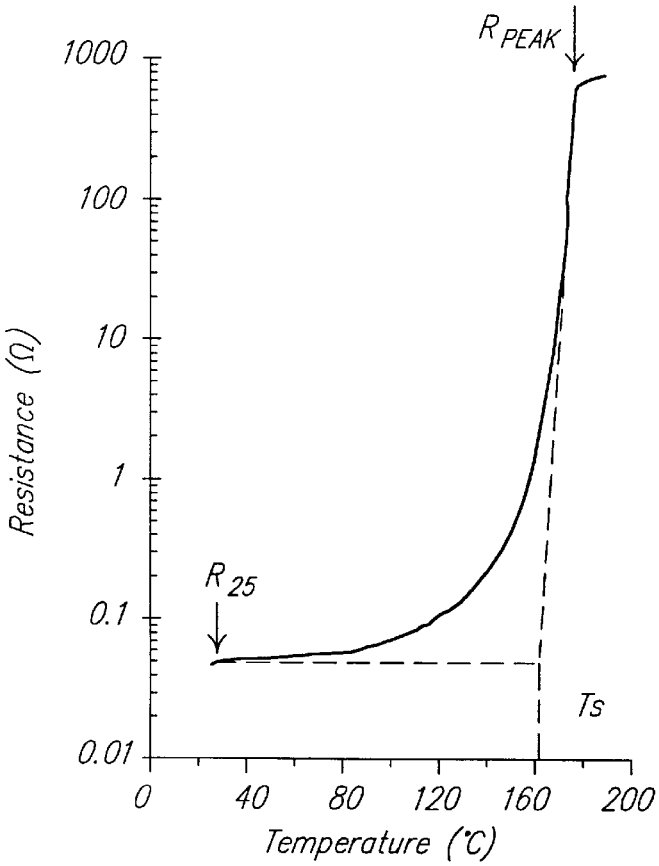
FIG. 3 is a graphical illustration of the PTC behavior of a typical nylon-12 composition comprising 35 volume % carbon black, where $R_{peak}$ is the resistance at the peak of a resistance versus temperature curve and $R_{25}$ is the resistance at room temperature (25° C.).
Figure 4:
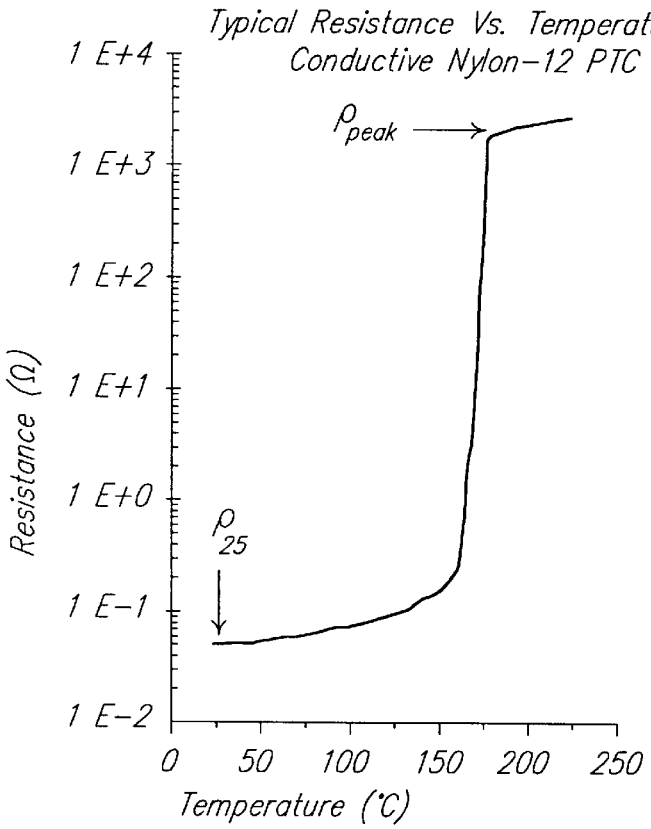
FIG. 4 is a graphical illustration of a typical resistance versus temperature curve of a conductive nylon-12 device.

An embodiment of the PTC device 10 is illustrated in FIG. 2, with terminals 12 and 14 attached to the PTC chip illustrated in FIG. 1. When an AC or a DC current is passed through the PTC device, the device demonstrates an initial resistance at 25° C. of about 500 mΩ or less, preferably about 200 mΩ or less. The ratio of the peak resistance ($R_{peak}$) of the PTC chip or device to the resistance of the chip/device at 25° C. ($R_{25}$) is at least $10^4$ to $10^5$, where $R_{peak}$ is the resistance at the peak of a resistance versus temperature curve that plots resistance as a function of temperature, as illustrated in FIGS. 3 and 4. The $T_s$ is shown in FIG. 3 as the temperature at the intersection point of extensions of the substantially straight portions of a plot of the log of the resistance of the PTC chip/device and the temperature which lies on either side of the portion showing the sharp change in slope. FIG. 4 illustrates a typical resistance versus temperature curve of a conductive nylon-12 device, such as those disclosed in the copending patent applications incorporated by reference above.

Figure 5:
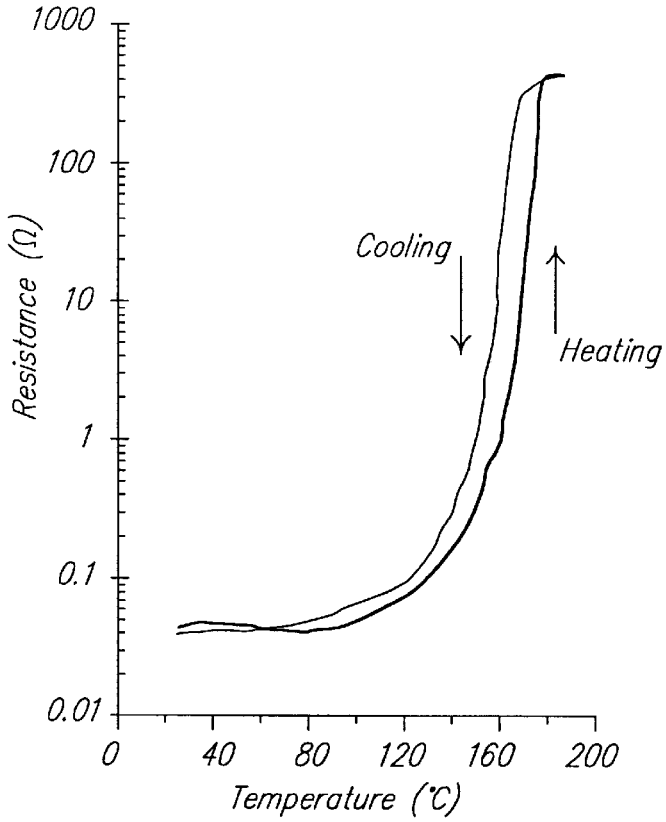
FIG. 5 is a graphical illustration of a typical resistance versus temperature curve during heating and cooling of a conductive nylon-12 device.

The high temperature PTC device manufactured by compression molding or by extrusion/lamination, as described below, and containing a crosslinked composition demonstrates electrical stability. As termed herein, a device demonstrating "electrical stability" has an initial resistance $R_o$ at 25° C. and a resistance $R_x$ at 25° C. after X cycles to the switching temperature and back to 25° C., wherein the value of the ratio $(R_x-R_o)/R_o$, which is the ratio of the increase in resistance after X temperature excursion, to the initial resistance at 25° C., is less than three times the $R_o$. A single excursion from 25° C. to the switching temperature and back to 25° C. is illustrated in FIG. 5. As termed herein, a device demonstrating "electrical and thermal stability" has an initial resistance $R_o$ at 25° C. and a resistance $R_y$ after Y minutes of "stall" at 110 to 130 VAC, and the value of the ratio $(R_y-R_o)/R_o$ is less than 1.5 times the $R_o$. The stall test is described herein below.

The conductive polymeric compositions of the invention are prepared by methods known in the art. In general, the polymer or polymer blend, the conductive filler and additives (if appropriate) are compounded at a temperature that is at least 20° C. higher, but no more than 120° C. higher, than the melting temperature of the polymer or polymer blend. The compounding temperature is determined by the flow property of the compounds. In general, the higher the filler content (e.g., carbon black), the higher is the temperature used for compounding. After compounding, the homogeneous composition may be obtained in any form, such as pellets. The composition is then subjected to a hot-press or extrusion/lamination process and transformed into a thin PTC sheet.

To manufacture the PTC sheet by compression molding, homogeneous pellets of the PTC composition are placed in a molder and covered with metal foil (electrodes) on top and bottom. The composition and metal foil sandwich is then laminated into a PTC sheet under pressure. The compression molding processing parameters are variable and depend upon the PTC composition. For example, the higher the filler (e.g., carbon black) content, the higher is the processing temperature and/or the higher is the pressure used and/or the longer is the processing time. By controlling the parameters of temperature, pressure and time, different sheet materials with various thicknesses may be obtained.

To manufacture a PTC sheet by extrusion, process parameters such as the temperature profile, head pressure, RPM, and the extruder screw design are important in controlling the PTC properties of resulting PTC sheet. Generally, the higher the filler content, the higher is the processing temperature used to maintain a head pressure in the range of 2000 to 6000 psi with a RPM in the range of 2 to 20. For example, in extruding 43 volume % carbon black/57 volume % nylon-12 (Aesno-TL) material, a die temperature as high as 265° C. has been employed. A screw with a straight-through design is preferred in the manufacture of PTC sheets. Because this screw design provides low shear force and mechanical energy during the process, the possibility of breaking down the carbon black aggregates is reduced, resulting in PTC sheets having low resistivity. The thickness of the extruded sheets is generally controlled by the die gap and the gap between the laminator rollers. During the extrusion process, metallic electrodes in the form of metal foil covering both the top and bottom of a layer of the polymer compound, are laminated to the composition.

Compositions, such as those described below in the Examples, that contain nylon-12 (or nylon-11), carbon black, magnesium oxide, and the like, in varying proportions, are processed by extrusion/lamination.

PTC sheets obtained, e.g., by compression molding or extrusion, are then cut to obtain PTC chips having predetermined dimensions and comprising the conductive polymeric composition sandwiched between the metal electrodes. The composition may be crosslinked, such as by irradiation, if desired, prior to cutting of the sheets into PTC chips. Electrical terminals are then soldered to each individual chip to form PTC electrical devices.

A suitable solder provides good bonding between the terminal and the chip at 25° C. and maintains a good bonding at the switching temperature of the device. The bonding is characterized by the shear strength. A shear strength of 250 Kg or more at 25° C. for a 2×1 $cm^2$ PTC device is generally acceptable. The solder is also required to show a good flow property at its melting temperature to homogeneously cover the area of the device dimension. The solder used generally has a melting temperature of 10° C., preferably 20° C. above the switching temperature of the device. Examples of solders suitable for use in the invention high temperature PTC devices are 63Sn/37Pb (Mp: 183° C.), 96.5Sn/3.5Ag (Mp: 221° C.) and 95Sn/5Sb (MP: 240° C.), all available from Lucas-Milhaupt, Inc., Cudahy, Wis.; or 96Sn/4Ag (Mp: 230° C.) and 95Sn/5Ag (Mp: 245° C.), all available from EFD, Inc., East Providence, R.I.

The following examples illustrate embodiments of the high voltage capacity conductive polymeric PTC compositions and electrical PTC devices of the invention. However, these embodiments are not intended to be limiting, as other methods of preparing the compositions and devices to achieve desired electrical and thermal properties may be determined by those skilled in the art. The compositions, PTC chips and PTC devices were tested for PTC properties directly by a resistance versus temperature (R-T) test and indirectly by a switching test, overvoltage test, cycle test, and stall test, as described below. The number of samples tested from each batch of chips is indicated below and the results of the testing reported in Table 2 and the Figures are an average of the values for the samples.

The PTC performance of the device is characterized by resistance, PTC effect, voltage capability, and the resistance increase ratio after the switch cycle and stall test. The resistance of the PTC chips and devices is measured, using a four-wire standard method, with a micro-ohmmeter (e.g., Keithley 580, Keithley Instruments, Cleveland, Ohio) having an accuracy of ±0.01 mΩ. To determine an average resistance value at 25° C., the resistance of at least 20 chips and devices is measured for each PTC composition.

The resistivity is calculated from the measured resistance and the geometric area and thickness of the chip. To determine the PTC effect, the resistance versus the temperature (R-T) curve is generated. A device sample is subjected to heating, typically by immersion in an oil bath (e.g., one having a constant heating rate of about 2° C. per minute). The temperature and resistance of each of the samples are recorded simultaneously with a computer data acquisition program. The PTC effect is calculated by the value of $R_{peak}/R_{25}$, as shown in Table 2.

The $T_s$ of the PTC composition comprising the PTC devices is determined by a constant voltage switching test, usually conducted by passage of a DC or AC current through the device at, for example, 130 VAC and 13 amperes (amps). Because of the self-heating caused by the high current, the device quickly reaches the $T_s$ and, with the voltage remaining constant, the current suddenly drops to a low value (trickle current). The devices exhibit the desired PTC effect if they are capable of staying and stabilizing at the $T_s$ for at least 180 seconds at the specified condition (e.g., 130 VAC and 13 amps). Failure of the device is indicated if the device is incapable of stabilizing at the $T_s$ for 180 seconds or undergoes "thermal runaway".

The relation between the PTC effect and the device voltage capability is shown below:

$$S=kV_k/P_0R$$

where S denotes the PTC effect, R denotes the device resistance at 25° C. (Ω), $V_k$ is the voltage capability of the device (volts), $P_0$ is the power dissipated of the device in the tripped state (watts), and k is the device constant. During the switch test, a computer data acquisition program automatically records the initial voltage, initial current, trickle current, the switching temperature and the switching time. A sample size of at least four was normally used for this test.

The cycle test is performed in a manner similar to the switching test, except that the switching parameters (voltage and amperage) remain constant during a specified number of switching cycle excursions from 25° C. to the $T_s$ and back to 25° C. The resistance of the device is measured at 25° C. before and after a specified number of cycles. The initial resistance at 25° C. is designated $R_o$ and the resistance after X numbers of cycles is designated $R_x$, e.g. $R_{100}$. The resistance increase ratio is $(R_x-R_o)/R_o$. The device is considered to have a substantially good electrical stability if it shows a resistance increase ratio of less than 300% after a certain number of cycle excursions. The cycle test sample size is generally five.

The stall test performance is another way to evaluate the electrical stability of the polymeric PTC switch devices. The test is conducted with a switch condition at, for example, 130 VAC and 13 amps under which the PTC device is allowed to trip to its $T_s$. After the switch, the high voltage operating condition is maintained for a certain period of time (the stall time), such as for 4, 8, 16 or 24 hours. At the end of the stall time, the power is removed and the device is allowed to cool to 25° C. The device resistance is then measured at 25° C. for comparison with its original resistance. The stall test sample size is generally five.

EXAMPLES

Example 1

Using the composition ratios listed in Table 2, carbon black (Sterling N-550) and magnesium oxide (MgO) were dry blended, then mixed with nylon-12 (Aesno TL) for 30 minutes in a Brabender two-roll mill that was heated to 250° C. The corresponding volume fraction of nylon-12 to carbon black for this composition is 60:40 (40 volume %). The homogeneous mixture was then cooled and chopped into pellets. The pelleted nylon-12/carbon black mixture was then introduced into an extruder/laminator. The die temperature in the extruder and the roller temperature of the laminator were controlled to be at 270° C. and 215° C., respectively. The process produced a sandwiched strip of PTC material in which both top and bottom layers were covered with nickel coated copper foils.

The resulting PTC strip material was subjected to γ-irradiation treatment with a dosage level indicated in Table 2. Subsequently, the strip material was cut into PTC chips with a dimension of 2×1 $cm^2$, having an average thickness and resistance shown in Table 2. The chip was soldered, using 96.5Sn/3.5Ag solder, with an oven heated to approximately 300° C. to install copper terminals.

Figure 6:
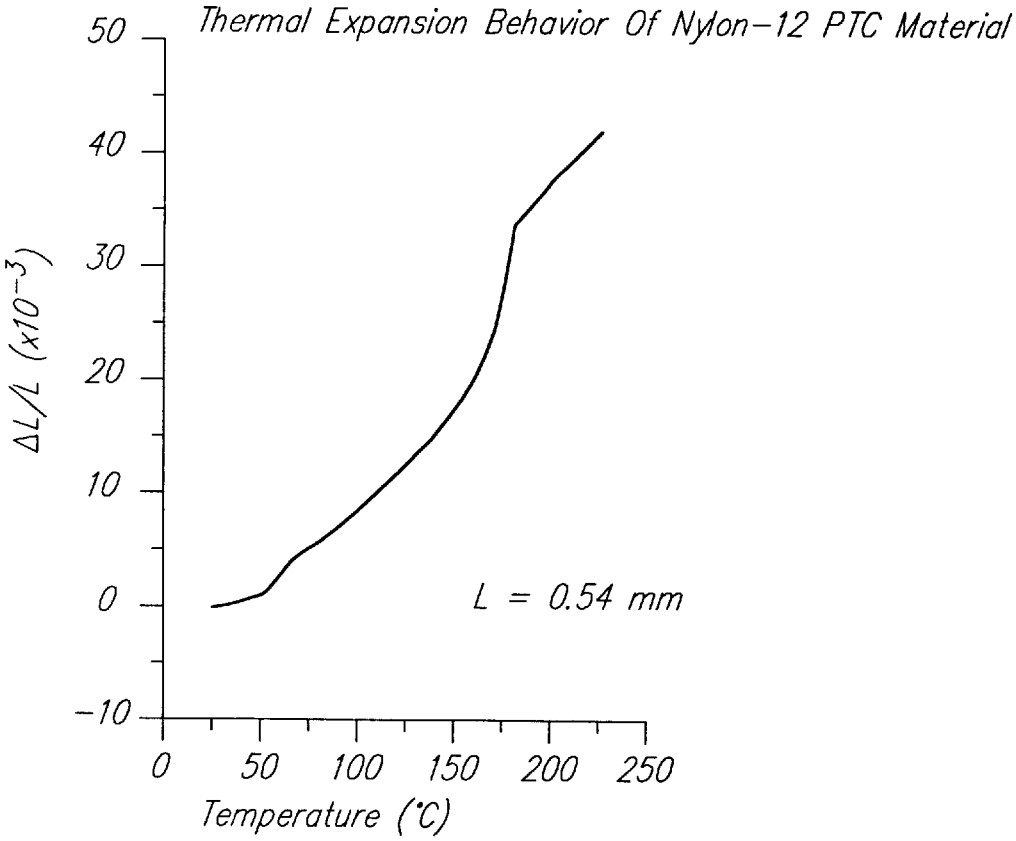
FIG. 6 is a graphical illustration of the thermal expansion behavior of a typical conductive nylon-12 material.

After the soldering process, the PTC device had a resistance of about 50–55 MΩ. The typical PTC effect, which was calculated from the R-T curve in FIG. 4, is $3.5\times10^4$. The thermal expansion behavior of the PTC material is illustrated in FIG. 6. A large positive coefficient of thermal expansion (CTE) of $1.3\times10^{-3}$ was observed at the temperature close to the $T_s$. The thermal expansion behavior is consistent with the observed high PTC effect.

Figure 7:
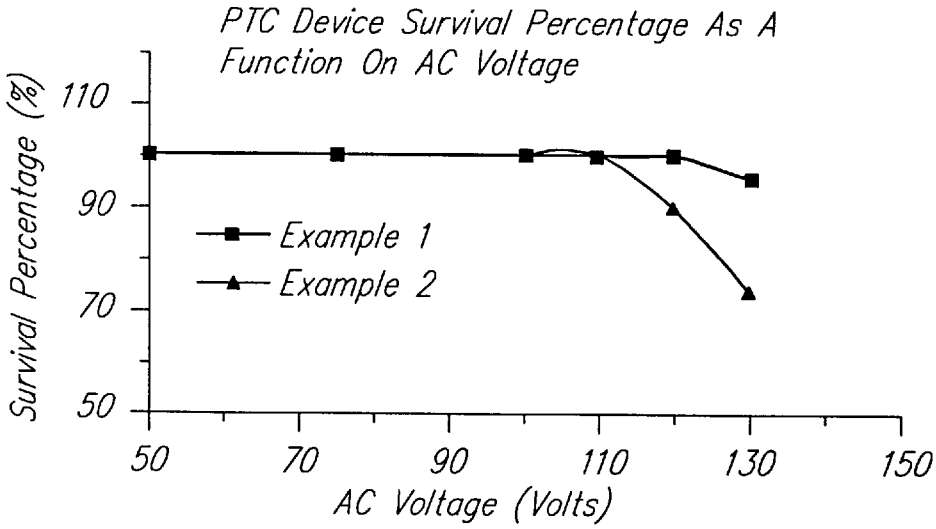
FIG. 7 is a graphical illustration of the survival percentages of the devices of Examples 1 and 2 as a function of the alternating current (AC) voltage.

Because of the excellent PTC behavior, the device of this Example withstood a high voltage up to 110 to 130 VAC without failure during the switch test. The results of the voltage capability testing are illustrated in FIG. 7. However, the material did not exhibit a high enough electrical stability. For example, the device survival percentage dropped with the increase in stall time (see FIG. 8 ), although the device resistance increase ratio after the stall or switch cycle tests were still in an acceptable range (see FIG. 9 and FIG. 10).

Example 2

A PTC composition and devices were prepared as described in Example 1, except that a different composition ratio (57:43) of nylon-12 to carbon black was used (43 volume %), an anti-oxidant agent (Irganox 1098) was added to the composition, a slightly lower die temperature was used for the extrusion process, and the composition was irradiated with a low level (2.5 Mrads) of gamma radiation. The laminated material had a thickness of 0.7 mm and a chip resistance of 30.6 mΩ. After the soldering process, the device resistance was about 52.3 mΩ.

Figure 11:
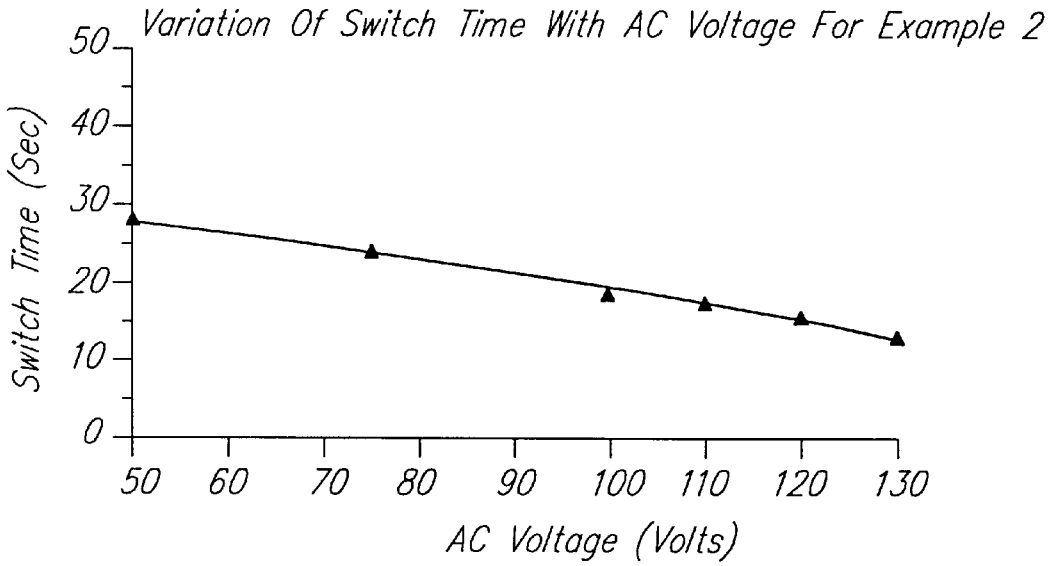
FIG. 11 is a graphical illustration of the length of the switch time as a function of the AC voltage for the device of Example 2.

The variation of the switch time with AC voltage for this device is shown in FIG. 11. In the tested voltage range from 50 to 130 VAC, the device generally exhibited a switch time of less than 30 seconds. The switch time increased with an increase in the AC voltage at 25° C. as the same current of 10 amperes (amps) was applied to make the device trip. In addition, this device had a slightly lower PTC effect ($3.2\times10^4$) and a slightly lower AC voltage capability than the device of Example 1 (see FIG. 7); however this device still demonstrated AC voltage capability in the Line voltage range of 110 to 130 VAC.

Figure 8:
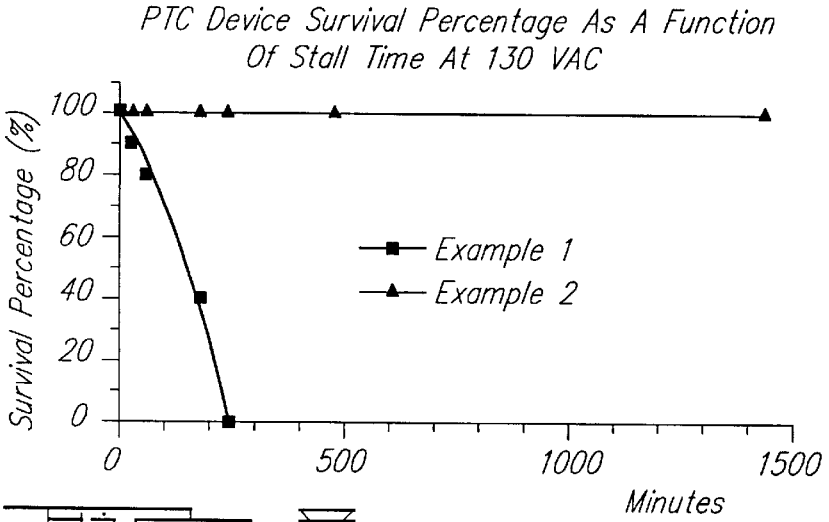
FIG. 8 is a graphical illustration of the survival percentages of the devices of Examples 1 and 2 as a function of the stall time at 130 alternating current volts (VAC).
Figure 9:
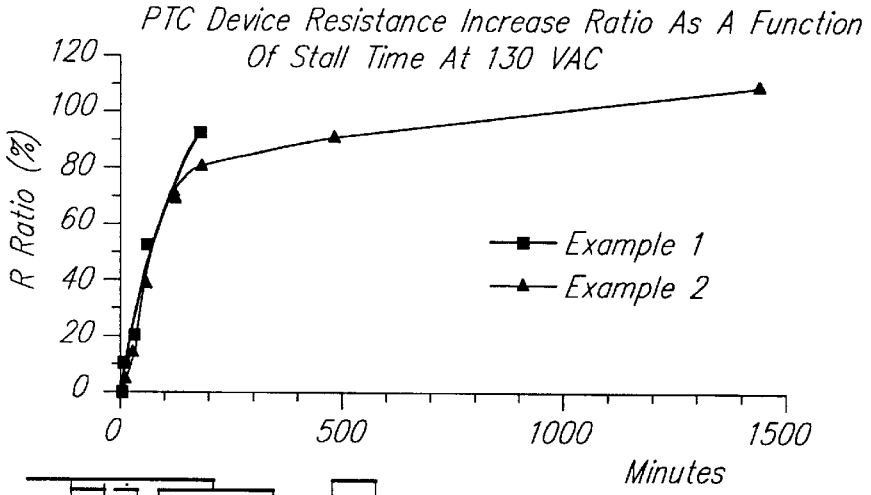
FIG. 9 is a graphical illustration of the resistance increase ratio of the devices of Examples 1 and 2 as a function of the stall time at 130 VAC.
Figure 10:
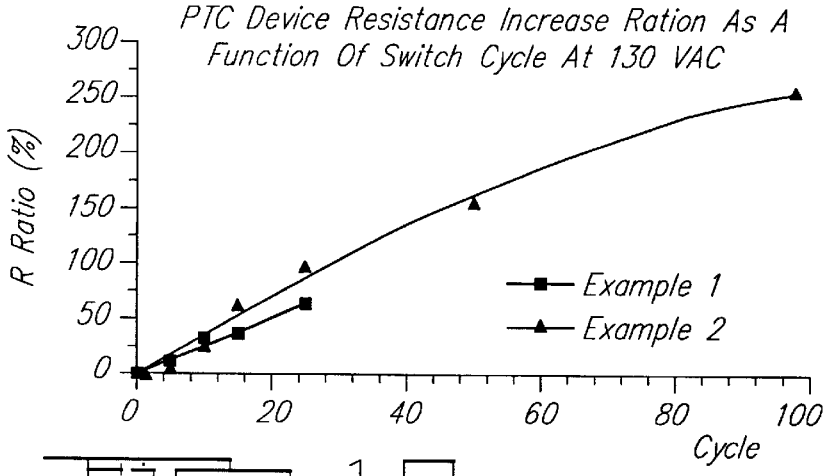
FIG. 10 is a graphical illustration of the resistance increase ratio of the devices of Examples 1 and 2 as a function of the number of switch cycles at 130 VAC.

A high electrical stability of this device was observed. As illustrated in FIG. 8 and FIG. 9, the device survived 24 hours of the stall test and had a lower resistance increase ratio after the test.

Example 3

Figure 12:
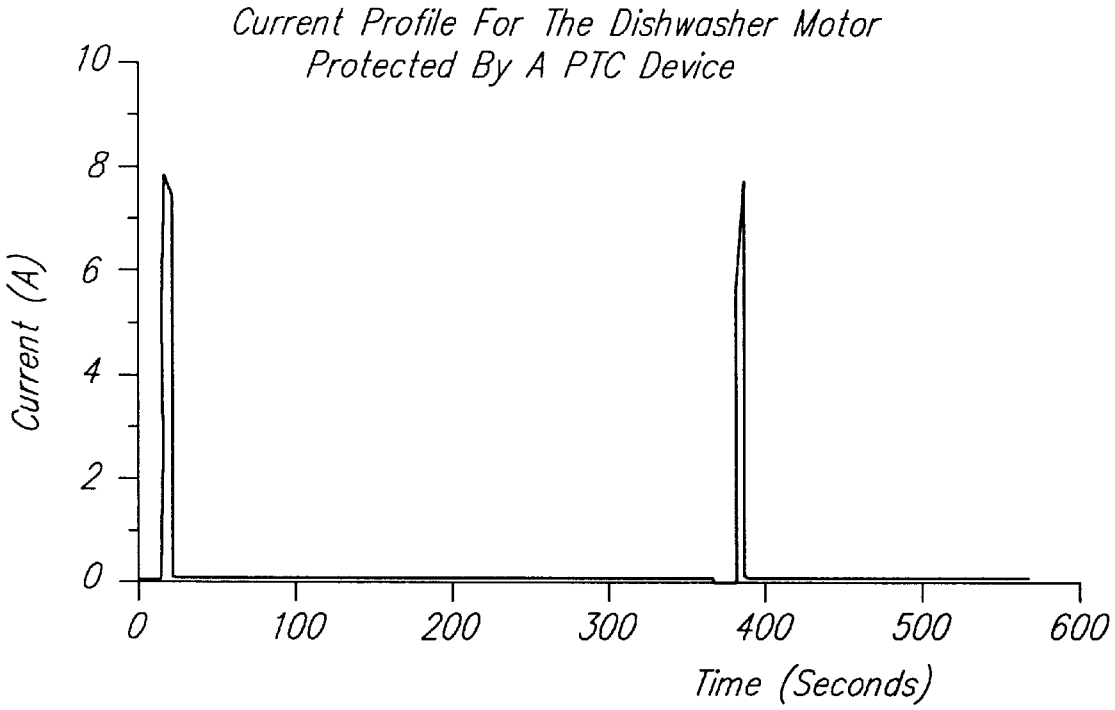
FIG. 12 is a graphical illustration of a current profile for a dishwasher motor protected by the device of Example 3.

A PTC device having the composition of Example 2 was installed in series in the motor circuit of a dishwasher motor which was operated at 120 VAC. The device had a dimension of $1\times1cm^2$ and had a resistance at 25° C. of 110.2 mΩ. The results of testing this device are illustrated in FIG. 12. The dishwasher rotor was locked in order to create a fault circuit current of about 7.8 amps. At that point, the PTC device self-heated and switched to a high resistance state where the current quickly dropped to a lower level (0.075 amps). The switch process took about 4.8 seconds to complete. After switching, the PTC device was stable at its latched state for about 360 seconds (6 minutes). Then the power was turned off for 15 seconds, and a second switch process then followed. The device was stable for at least another 180 seconds (3 minutes) without failure.

TABLE 2

| Composition | Example 1 | Example 2 |
|---|---|---|
| Nylon-12/Carbon Black (volume%) | 40 | 43 |
| Nylon 12(Aesno TL)(grams) | 121.1 | 115.1 |
| Carbon Black (Sterling N550)(grams) | 131.2 | 141.0 |
| MgO (grams) | 9.0 | 9.1 |
| Irganox 1098 (grams) | 0 | 7.7 |
| Die Temperature (° C.) | 270 | 265 |
| Irradiation (Mrad) | 10 | 2.5 |
| Resistivity (Ωcm) | 1.49 | 1.02 |
| Chip Thickness (mm) | 0.50 | 0.70 |
| Chip Resistance (mΩ) | 31.3 | 30.6 |
| Device Resistance (mΩ) | 55.7 | 52.3 |
| PTC Effect | $3.6\times10^4$ | $3.2\times10^4$ |

While the invention has been described herein with reference to the preferred embodiments, it is to be understood that it is not intended to limit the invention to the specific forms disclosed. On the contrary, it is intended to cover all modifications and alternative forms falling within the spirit and scope of the invention.

We claim:

1. A polymeric PTC composition comprising a crystalline or semicrystalline polymer including nylon-12, nylon-11, or mixtures or copolymers thereof, a particulate conductive filler, an inorganic additive and, optionally, an antioxidant, the composition having a resistivity at 25° C. of 100 Ωcm or less and a resistivity at its switching temperature that is at least $10^4$ to $10^5$ times the resistivity at 25° C., the composition being able to withstand a voltage of 110 to 130 VAC or greater while maintaining electrical and thermal stability.

2. The composition of claim 1, wherein the polymer has a melting point, $T_m$ of 100° C. to 200° C.

3. The composition of claim 2, wherein the composition exhibits a thermal expansion coefficient of $4.0\times10^{-4}$ to $2.0\times10^{-3}$ cm/cm° C. at a temperature in the range of $T_m$ to $T_m$ minus 10° C.

4. The composition of claim 1, having a resistivity at 25° C. of 10 Ωcm or less.

5. The composition of claim 4, having a resistivity at 25° C. of 5 Ωcm or less.

6. The composition of claim 5, having a resistivity at 25° C. of 2 Ωcm or less.

7. The composition of claim 1, wherein the particulate conductive filler is selected from the group consisting of carbon black, graphite, metal particles, and mixtures thereof.

8. The composition of claim 7, wherein the metal particles are selected from the group consisting of nickel particles, silver flakes, or particles of tungsten, molybdenum, gold, platinum, iron, aluminum, copper, tantalum, zinc, cobalt, chromium, lead, titanium, tin alloys, and mixtures thereof.

9. The composition of claim 1, wherein the inorganic additive is selected from the group consisting of magnesium oxide, zinc oxide, aluminum oxide, titanium oxide, calcium carbonate, magnesium carbonate, alumina trihydrate, magnesium hydroxide, and mixtures thereof.

10. The composition of claim 1, wherein the antioxidant comprises a phenol or an aromatic amine.

11. The composition of claim 10, wherein the antioxidant is selected from the group consisting of N,N'-1,6-hexanediylbis(3,5-bis(1,1-dimethylethyl)-4-hydroxybenzene) propanamide, (N-stearoyl-4-aminophenol, N-lauroyl-4-aminophenol, polymerized 1,2-dihydro-2,2,4-trimethyl quinoline, and mixtures thereof.

12. The composition of claim 1, including about 10% to about 70% by volume of the particulate conductive filler.

13. The composition of claim 12, including about 20% to about 60% by volume of the particulate conductive filler.

14. The composition of claim 13, including about 30% to about 50% by volume of the particulate conductive filler.

15. The composition of claim 1, including about 1% to about 15% by weight of the inorganic filler.

16. The composition of claim 1, including about 2% to about 7.5% by weight of the inorganic filler.

17. The composition of claim 1, wherein the optional antioxidant is present at about 0.1% to about 15% by weight.

18. The composition of claim 17, wherein the antioxidant is present at about 0.5% to about 7.5% by weight.

19. The composition of claim 1, wherein the polymeric composition is crosslinked with the aid of a chemical agent or by irradiation.

20. The composition of claim 1, further comprising about 0.5% to about 20% by volume of a second semicrystalline polymer.

21. The composition of claim 20, wherein the second polymer has a melting temperature $T_m$ of about 100° C. to about 200° C.

22. The composition of claim 21, wherein the second polymer has a thermal expansion coefficient value at a temperature in the range of $T_m$ to $T_m$ minus 10° C. that is at least four times greater than the thermal expansion coefficient value at 25° C.

23. The composition of claim 20, wherein the second polymer is selected from a polyolefin-based or a polyester-based thermoplastic elastomer, and mixtures and copolymers thereof.

24. An electrical device which exhibits PTC behavior, comprising:

(a) a conductive polymeric composition that comprises a crystalline or semicrystalline polymer including nylon-12, nylon-11, or mixtures or copolymers thereof, a particulate conductive filler, an inorganic additive and, optionally, an antioxidant, the composition having a resistivity at 25° C. of 100 Ωcm or less and a resistivity at its switching temperature that is at least $10^4$ to $10^5$ times the resistivity at 25° C.; and (b) at least two electrodes which are in electrical contact with the conductive polymeric composition to allow a DC or an AC current to pass through the composition under an applied voltage, wherein the device has a resistance at 25° C. of 500 mΩ or less with a desirable design geometry, and wherein the device can withstand a voltage of 110 to 130 VAC or greater without failure for at least 4 hours after reaching its switching temperature.

25. The device of claim 24, wherein the device can withstand the voltage for at least 8 hours after reaching its switching temperature.

26. The device of claim 25, wherein the device can withstand the voltage for at least 16 hours after reaching its switching temperature.

27. The device of claim 26, wherein the device can withstand the voltage for at least 24 hours after reaching its switching temperature.

28. The device of claim 24, wherein the device has a resistance at 25° C. of about 7.5 mΩ to about 200 mΩ.

29. The device of claim 28, wherein the device has a resistance at 25° C. of about 10 mΩ to about 100 mΩ.

30. The device of claim 25, further comprising an electrical terminal soldered to an electrode by a solder having a melting temperature at least 10° C. above the switching temperature of the composition.

31. The device of claim 30, wherein the solder has a melting point of about 180° C. or greater.

32. The device of claim 31, wherein the solder has a melting point of about 220° C. or greater.

33. The device of claim 24, wherein the composition further comprises about 0.5% to about 20% by volume of a second semicrystalline polymer.

34. The device of claim 33, wherein the second polymer is selected from a polyolefin-based or a polyester-based thermoplastic elastomer.

35. The device of claim 24, produced by compression molding.

36. The device of claim 24, produced by extrusion/lamination.

37. The device of claim 24, having an initial resistance $R_o$ at 25° C. and a resistance $R_y$ at 25° C. after Y minutes of stall at 110 to 130 VAC and the value of $(R_y-R_o)/R_o$ is less than 1.5 times the $R_o$.

38. The device of claim 24, having an initial resistance $R_o$ at 25° C. and a resistance $R_x$ at 25° C. after X cycles to the switching temperature and back to 25° C., and the value of $(R_x-R_o)/R_o$ is less than three times the $R_o$.

* * * * *

UNITED STATES PATENT AND TRADEMARK OFFICE

CERTIFICATE OF CORRECTION

PATENT NO. : 6,074,576
DATED : June 13, 2000
INVENTOR(S) : Zhao et al.

It is certified that error appears in the above-identified patent and that said Letters Patent is hereby corrected as shown below:

Title page,
Related U.S. Application Data,
"which is a continuation-in-part of application no. 08/729,822, Oct. 8, 1996, Pat. No. 5,837,164" should be deleted as it is a duplicate entry.

OTHER PUBLICATIONS
After "B.", insert -- K. --.

Column 1,
Lines 8 and 9, "which is a continuation-in-part of Ser. No 08/729,822, now U.S. Patent No. 5,837,164" should be deleted as it is a duplicate entry.

Column 3,
Line 31, "10-4" should be -- $10^{-4}$ --.
Line 50, "withstand" should be -- withstanding --.

Column 4, claim 30,
Line 18, "25" should be -- 24 --.
Line 46, "Ts" should be -- $T_s$ --

Column 9,
Line 25, "MP:" should be -- Mp: --.

Column 11,
Line 5, MΩ" should be -- mΩ --.

Signed and Sealed this

Twenty-fifth Day of December, 2001

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,074,576
DATED : June 13, 2000
INVENTOR(S) : Zhao et al.

It is certified that error appears in the above-identified patent and that said Letters Patent is hereby corrected as shown below:

Title page,
Related U.S. Application Data,
"which is a continuation-in-part of application no. 08/729,822, Oct. 8, 1996, Pat. No. 5,837,164" should be deleted as it is a duplicate entry.

OTHER PUBLICATIONS
After "B.", insert -- K. --.

Column 1,
Lines 8 and 9, "which is a continuation-in-part of Ser. No 08/729,822, now U.S. Patent No. 5,837,164" should be deleted as it is a duplicate entry.

Column 3,
Line 31, "10-4" should be -- $10^{-4}$ --.
Line 50, "withstand" should be -- withstanding --.

Column 4, claim 30,
Line 18, "25" should be -- 24 --.
Line 46, "Ts" should be -- $T_s$ --

Column 9,
Line 25, "MP:" should be -- Mp: --.

Column 11,
Line 5, MΩ" should be -- mΩ --.

Signed and Sealed this

Eighth Day of January, 2002

*Attest:*

*Attesting Officer*

JAMES E. ROGAN
*Director of the United States Patent and Trademark Office*